US006234247B1

(12) United States Patent
Head

(10) Patent No.: US 6,234,247 B1
(45) Date of Patent: May 22, 2001

(54) BORE HOLE SAFETY VALVES

(76) Inventor: Philip Head, 178 Brent Crescent, London, NW10 7XR (GB)

( * ) Notice: Subject to any disclaimer, the term of this patent is extended or adjusted under 35 U.S.C. 154(b) by 0 days.

(21) Appl. No.: 09/317,357

(22) Filed: May 24, 1999

(30) Foreign Application Priority Data

May 28, 1998 (GB) ..... 9811511
Aug. 20, 1998 (GB) ..... 9818229

(51) Int. Cl.[7] ..... E21B 43/12

(52) U.S. Cl. ..... 166/65.1; 166/66.6; 166/106; 166/332.8

(58) Field of Search ..... 166/65.1, 66.6, 166/106, 332.8, 319, 325

(56) References Cited

U.S. PATENT DOCUMENTS 4,425,965 1/1984 Bayh ..... 161/106
4,529,035 7/1985 Bayh ..... 166/106
4,749,341 * 6/1988 Bayh, III ..... 166/214
5,236,047 8/1993 Pringle ..... 166/369
5,285,850 2/1994 Bayh ..... 166/321
5,411,096 5/1995 Akkerman ..... 166/321

* cited by examiner

*Primary Examiner*—William Neuder
(74) *Attorney, Agent, or Firm*—Herbert Dubno

(57) ABSTRACT

A safety valve and pump apparatus has an electric pump, a safety valve, a packing means, a continuous length of tubing extending from the surface to the location of the safety valve and pump, a control means provided to operate the safety valve and the pump, and a transmission means disposed along the tubing to transmit signals from the control means to the safety valve and the pump. The tubing, the safety valve and the pump are all being concentrically aligned The electric pump is releasably attached to the safety valve by pump connection means, so that the pump may be disconnected from the apparatus above and left in the well, and may afterwards be retrieved. Likewise, the safety valve is releasably attached to the packing means by packer connection means.

4 Claims, 8 Drawing Sheets

BORE HOLE SAFETY VALVES

FIELD OF THE INVENTION

The present invention relates to bore hole safety valves and in particular to installing and activating bore hole safety valves for oil well and like bore holes.

BACKGROUND OF THE INVENTION

In the drilling and operation of oil wells, it is necessary to isolate the well in the event of a catastrophe occurring to the well which may lead to the uncontrolled release of the oil and/or gas from the well into the surrounding area. This isolation is provided by valves which are normally biased to the closed position but which are actively maintained open during the operation of the bore hold. Such valves are known as subsurface safety valves or SSSVs for short, and are located at a convenient location down the well. (Although the term "down" is used, some bore holes may have considerable lengths which are far from vertical, and may be substantially horizontal.)

Such SSSVs are typically flapper type valves which seal off the whole bore of the production tube and are arranged above a packer which seals the production tubing to the existing surrounding casing of the well. Conventionally, SSSVs are fitted by arranging them on the end of the joined production tubing and lowering the tubing in the well by connection of subsequent lengths of joined production tubing until the desired location for the SSSV is reached. The packer may be attached to the SSSV at the remote end of the tubing and installed and activated together with the SSSV or alternatively the packer may already be in place and the SSSV located above it.

An hydraulic control line is provided on the outside of the joined tubing which is used to activate the SSSV to maintain it in the open position for use. It will be appreciated that if pressure is lost for any reason, for example in the event of a disaster, then the SSSV will automatically close, closing the well and preventing the release of any of the well fluids.

OBJECTS OF THE INVENTION

The general object of the present invention is to provide an improved technique for installing and activating bore hole safety valves.

SUMMARY OF THE INVENTION

According to the present invention there is provided a safety valve and pump apparatus including;

an electric pump, a safety valve, a packing means, a continuous length of tubing extending from the surface to the location of the safety valve and pump, a control means provided to operate the safety valve and the pump, and a transmission means disposed along the tubing for the transmission of signals from the control means to the safety valve and the pump, the tubing, the safety valve and the pump all being concentrically aligned.

Preferably the electric pump is releasably attached to the safety valve by pump connection means. Preferably the safety valve is releasably attached to the packing means by packer connection means. Preferably an electrical connection means is provided, and the coiled tubing and the transmission means are remotely releasably attached to the electrical connection means. Preferably a well head electrical supply is provided, and the electrical connection means is remotely releasably attachable to the well head electrical supply.

Preferably a safety valve and an electric pump as defined above are provided.

Thus by means of the invention any damage to an eternal hydraulic cable is prevented. Also, the safety valve housing is retrievable, which is a significant advantage in the event of failure of the safety valve for any reason. Conventionally, if the safety valve fails, an additional safety valve is fitted inside the existing production tube which puts severe limitations on the dimensions of the subsequent production tube. Alternatively the production tube is removed and the failed safety valve removed by drilling, such a method is expensive and there is a high risk of damage to the casing and other elements of the well.

Packing means refers to at least a surface which, in conjunction with a corresponding surface in the well casing, causes the safety valve to be sealed against the well casing.

SPECIFIC DESCRIPTION

Figure 1:
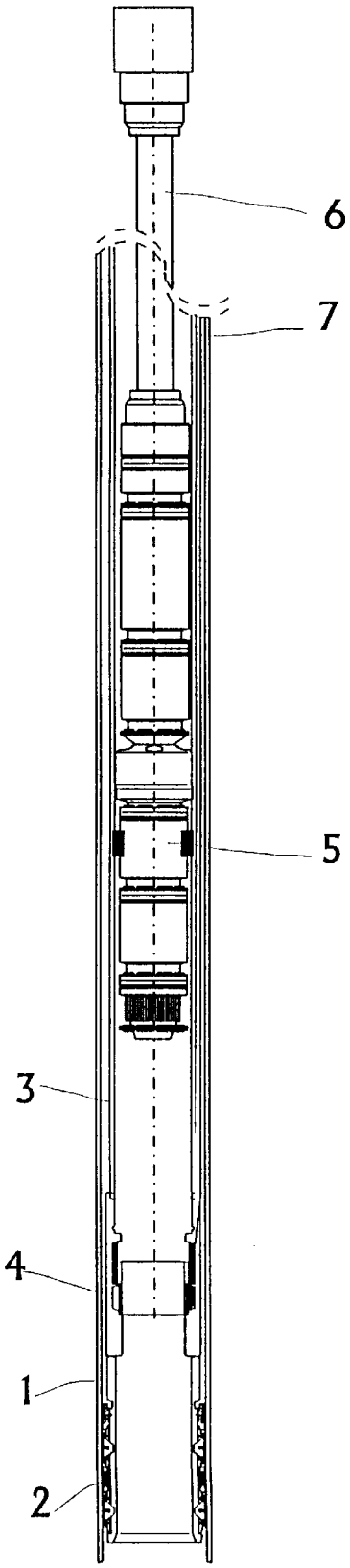
FIG. 1 is a longitudinal section through a known apparatus for fitting a safety valve housing with the valve in the open position.
Figure 2:
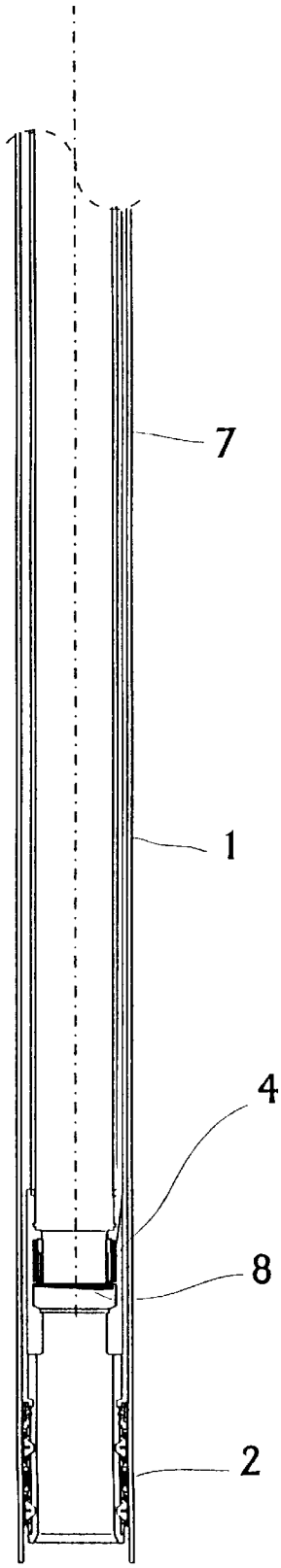
FIG. 2 is a longitudinal section through a known apparatus for fitting a safety valve housing with the valve in the closed position.

FIG. 1 shows a prior art safety valve housing 4 which is located within a well casing 1 and is fixed to a packer 2 which is sealed against the internal wall of the casing 1. All fluids which flow out of the well are therefore constrained to flow through the valve 4 and up through the production tubing 3. An hydraulic line passes through the annular space between the production tubing and the casing from the surface to the safety valve housing 4 and is used to activate the valve 4 to maintain it in the open position as shown in FIG. 1 so that oil and gas may be produced from the well. The pump 5 is located above the safety valve housing 4 and serves to pump the fluids out of the well. The safety valve housing 4 may be closed by activation by means of pressure changes transmitted by the hydraulic line which allows the flapper valve 8 to form a seal across the whole of the bore preventing any fluid flow. The flapper valve 8 will have an automatic bias to the closed position so that it will be closed in the event of a failure in the pressure in the hydraulic line 4.

Figure 3:
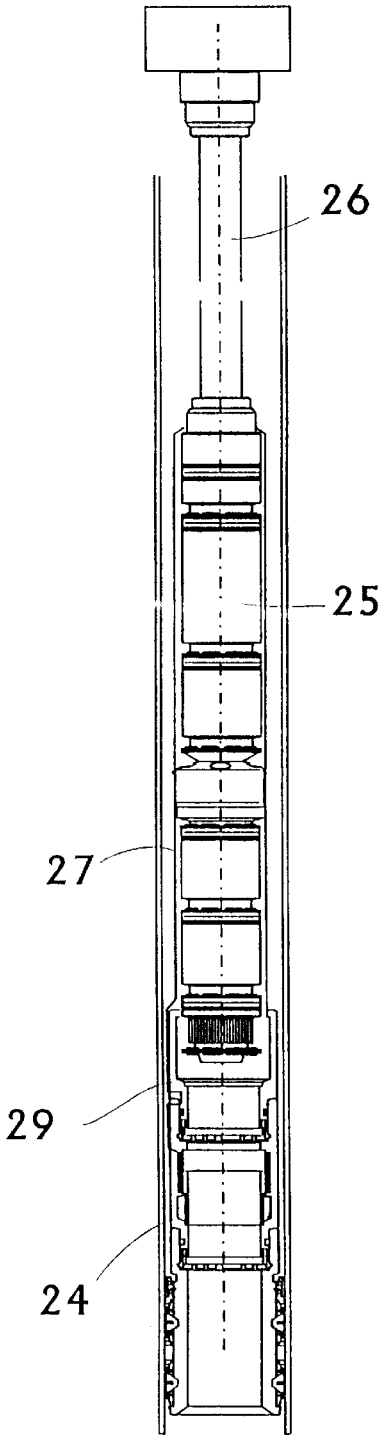
FIG. 3 is a longitudinal section through an apparatus according to an embodiment of the invention with the valve in the open position.
Figure 4:
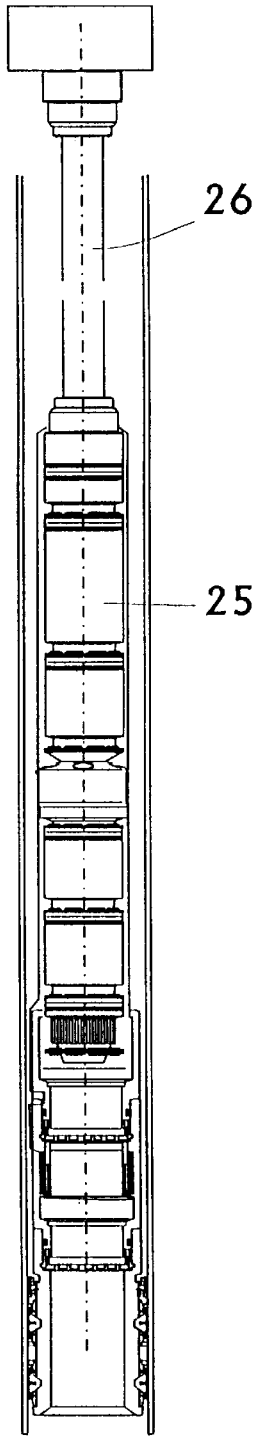
FIG. 4 is a longitudinal section through an apparatus according to an embodiment of the invention with the valve in the closed position.
Figure 5:
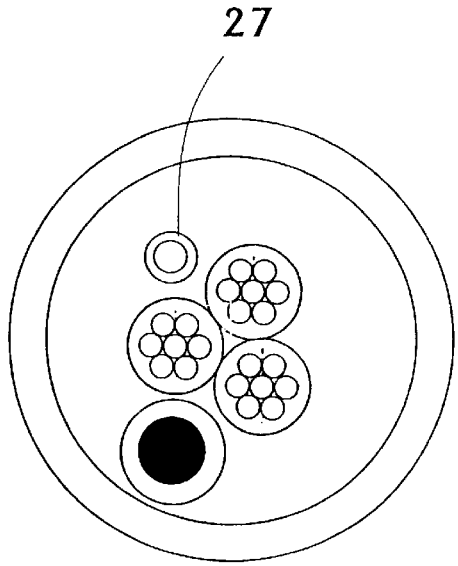
FIG. 5 is a cross section through the coiled tubing.

Referring now to FIGS. 3 to 5 an embodiment of the invention is shown in which an apparatus for installing activating and retrieving a safety valve housing 24 in a well, including a continuous length of coiled tubing 26, sufficiently long to extend from the surface to a required location for the safety valve housing 24. An electric transmission means 27 is arranged within the coiled tubing and is connected to electric control means for activating the safety valve housing. (This could also be hydraulic control means or other suitable activation means). In the embodiment of FIGS. 3 and 4 the electric control and transmission means exits the end of the cooled tubing 26 at the connection with the motor of the submersible pump 25. At the opposite end of the pump 25 the control line enters a shroud 29 which is connected to the valve 24. Thus the flapper valve 28 of the valve 24 is operated by the electric control and means 27 which is maintained within the coiled tubing during the lowering of the control valve and considerably reduces the risk of damage to the cable. In the embodiment shown in FIG. 12 the electric cable extends through the inside of the hollow motor, thus avoiding the necessity for the cable to be exposed outside the system to any extent and thus eliminating any risk of external damage to the cable during lowering of the control valve.

Figures 6, 7, 8, 9:
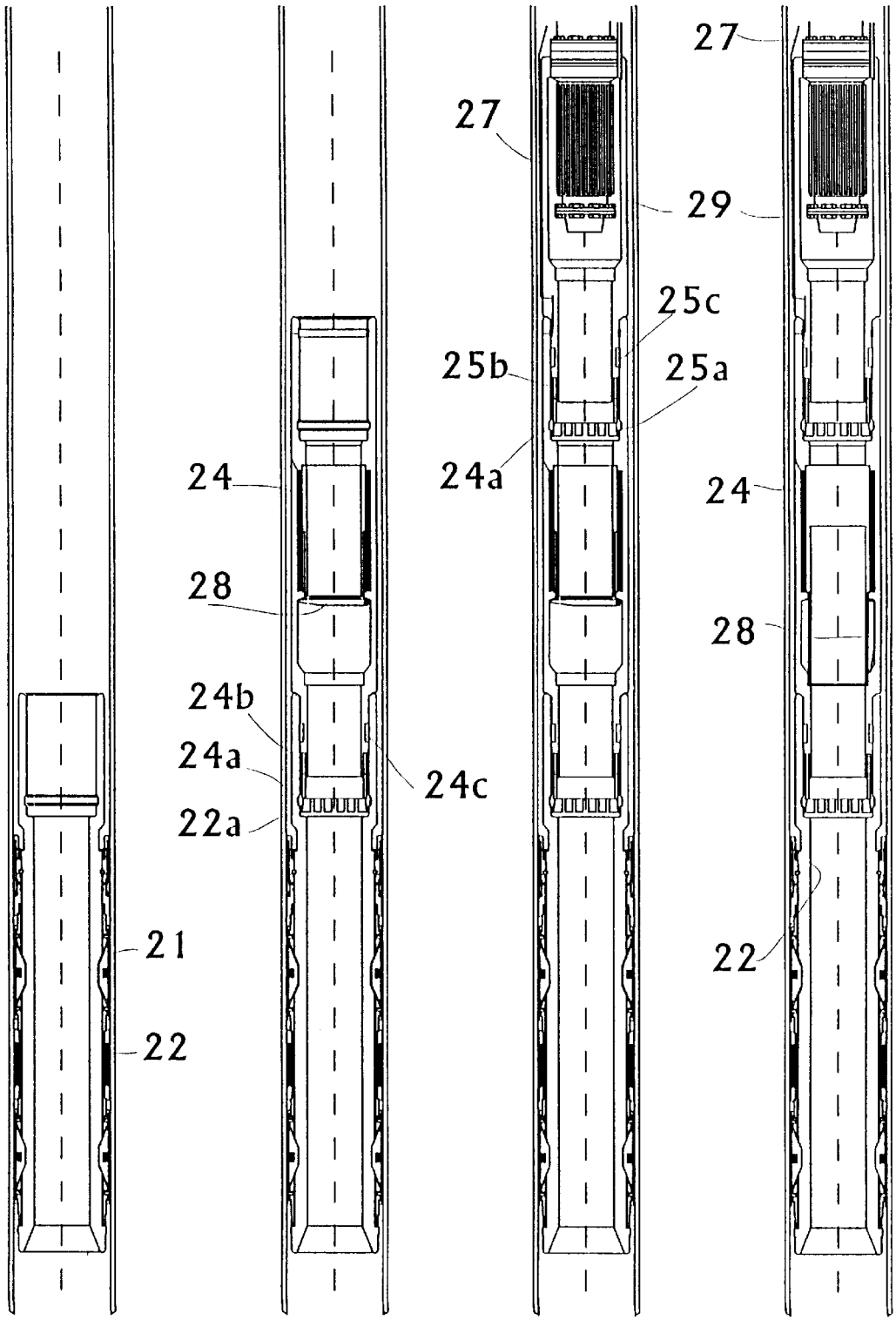
FIG. 6 is an enlarged longitudinal section through an apparatus according to an embodiment of the invention in the region of the safety valve housing, before its installation.
FIG. 7 is an enlarged longitudinal section through an apparatus according to an embodiment of the invention in the region of the safety valve housing, after its installation.
FIG. 8 is an enlarged longitudinal section through an apparatus according to an embodiment of the invention in the region of the safety valve housing, after attachment of a submersible pump.
FIG. 9 is an enlarged longitudinal section through an apparatus according to an embodiment of the invention in the region of the safety valve housing, after opening of the safety valve housing.

Referring to FIGS. 6 to 13, an example of a procedure for installing the safety valve housing 24 is shown. FIG. 6 shows a packer 22 which is already in position and sealed against the casing wall 21. It will be appreciated that the packer could be fitted at the same time as the safety valve housing and semi-submersible pump 25 and the packer activated when in the required position by means of the same electric cable 27.

Figure 13:
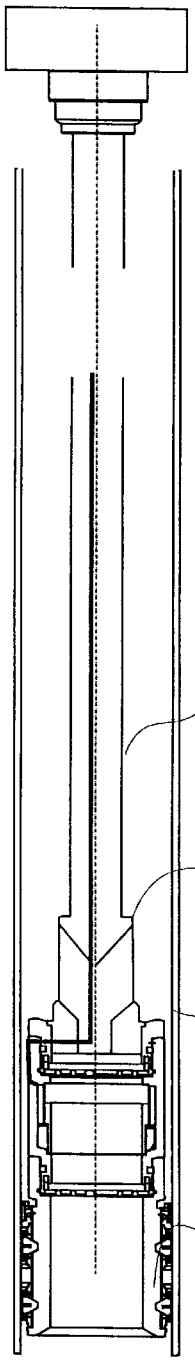

FIG. 7 shows the safety valve housing fitted in position. The safety valve housing 24 has been lowered by the coiled tubing 26 which has then been returned to surface. As shown in FIG. 13 the coiled tubing is releasably connected to the upper end of the safety valve housing 24 by means of a releasable latch mechanism. The flapper valve 28 is closed and the well is thus made safe.

Figure 10:
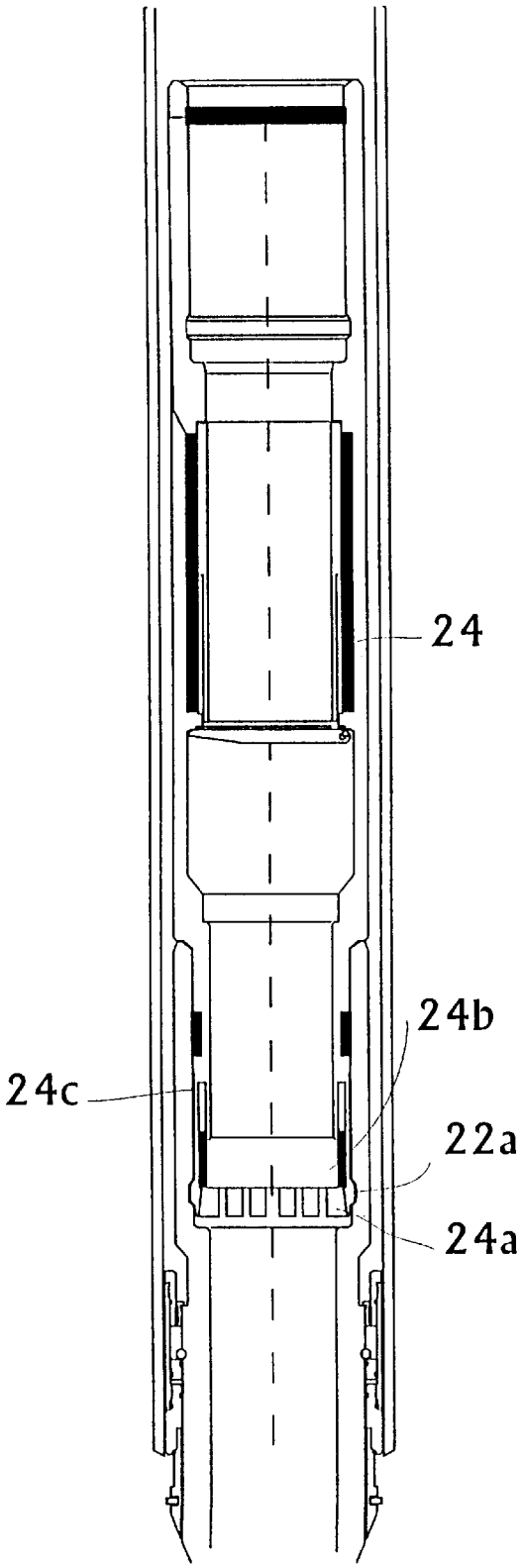
FIGS. 10 and 11 are enlarged longitudinal sections through the apparatus showing the disconnection of the safety valve housing.
Figure 11:
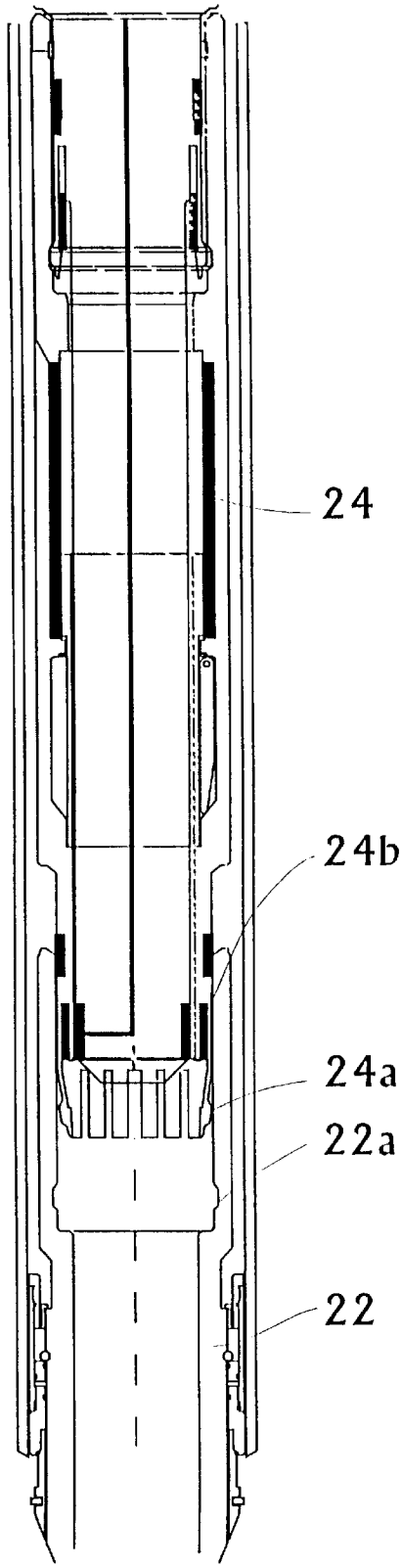

As shown in greater detail in FIGS. 10 and 11, the safety valve housing 24 is automatically fitted into the upper end of the packer 22 by means of spring fingers 24*a* which are maintained in an outwardly oriented position by a collar 24*b* so that they engage into a locking groove 22*a* in the packer 22.

When it is required to produce from the well the coiled tubing 26 re-enters the well, this time with a pump 25 arranged on its end. It will be appreciated again that the packer, safety valve housing and pump could be fitted in the same operation. The lower end of the pump 25 engages in the upper end of the safety valve housing 24 by means of spring fingers 25*a* which are urged outwardly by collar means 25*b* into a locating groove 24*d* in the safety valve housing 24. The arrangement of fingers, groove and collar are substantially the same as the fingers, groove and collar for attaching the valve housing to the packer.

When connected as shown in FIG. 9, the flapper valve 28 is activated and the apparatus is ready to produce oil and/or gas. The flapper valve 28 is operated by electric activation through the electric cable 27 which runs through the side wall of the shroud 29 and is electrically connected to the valve housing 24 by means not shown.

An electrical connection also continues to the lower end of the safety valve housing 24 to activate the collar 24*b*. This is to enable the safety valve housing 24 to be removed in the event of any damage or fault in the safety valve. Referring to FIGS. 10 and 11, the collar 24*b* is activated for example by means of a coil (not shown) causing the collar to move upwards into the slot 24*c*, thus releasing the fingers 24*a* from being urged outwardly. The fingers 24*a* are free to move inwardly and thus the safety valve may then be pulled free from the groove 22*a* in the packer 22 and removed. In this way this releasable connecting means permits the releasable securing of the safety valve housing in the required position. FIG. 11 shows the safety valve housing 24 just after it has ben pulled away from the packer 22.

Figure 12:
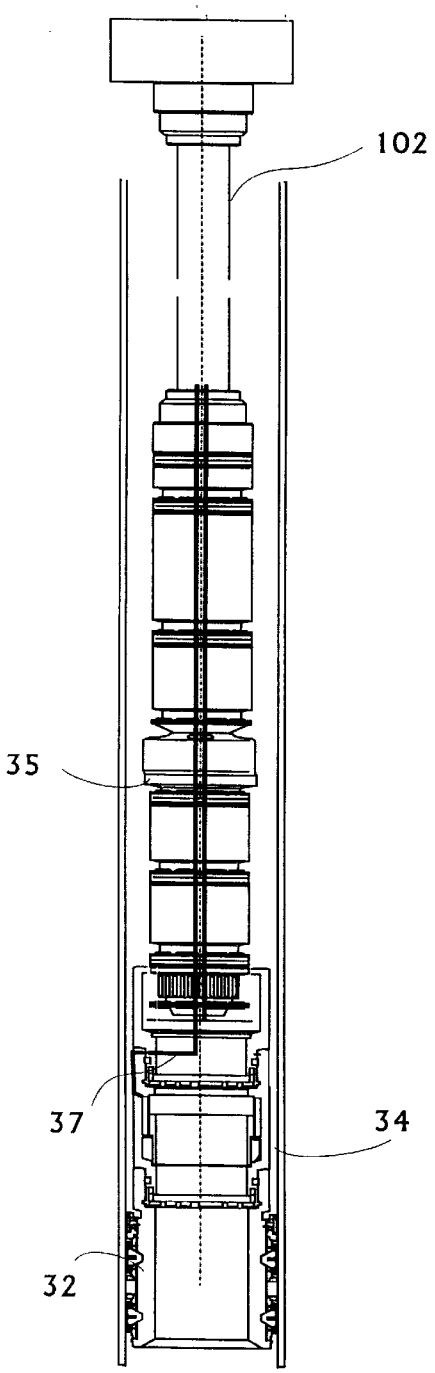
FIGS. 12, 13 and 13*a* are sectional views which show further embodiments of the safety valve and pump apparatus.

Referring now to FIG. 12, an alternative embodiment of the pump 35 is shown which is driven by a hollow motor 35*a* which enables the electric cable 37 to pass through the center of the motor directly to the safety valve 34 to operate the flap valve 38 and the releasable connection as well as to activate the packer if necessary. Thus the electric cable 37 is protected from any exposure to the outside of the apparatus at any time.

Figure 13A:
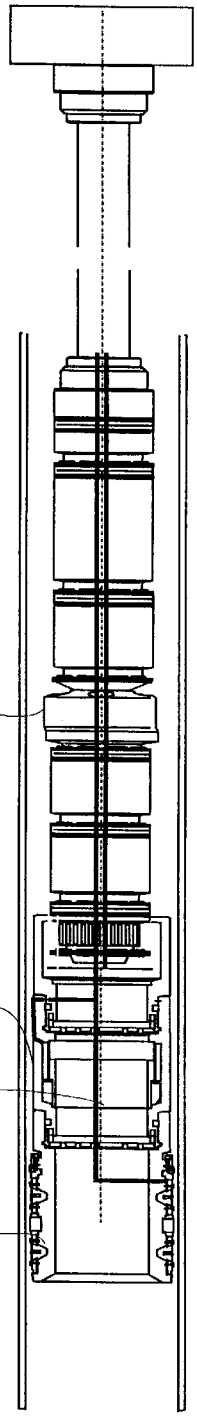

Referring now to FIG. 13*a*, a further embodiment of the safety valve is shown in which an electric or hydraulic control line 40 allows a retrievable packer 22 to be deactivated and removed from the well at the same time as the pump 35 and safety valve assembly 34.

Figure 14:
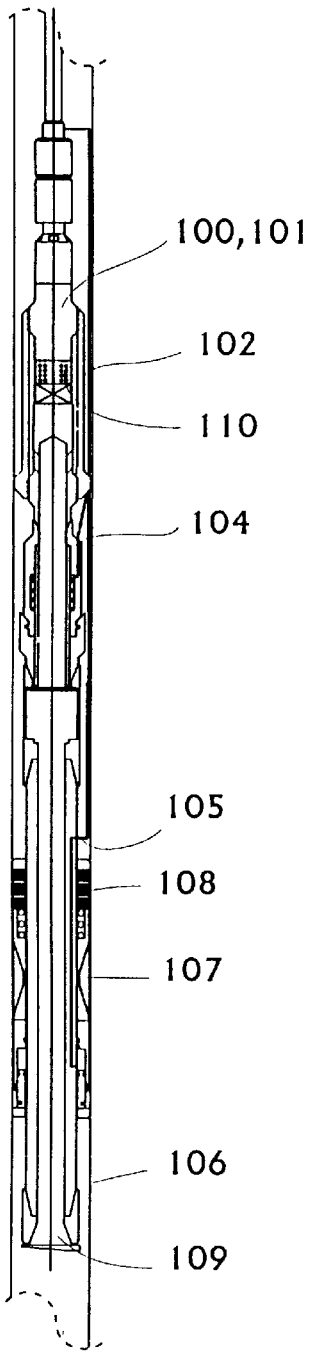
FIGS. 14 to 16 are sectional views which show further embodiments of the safety valve and pump apparatus.
Figure 15:
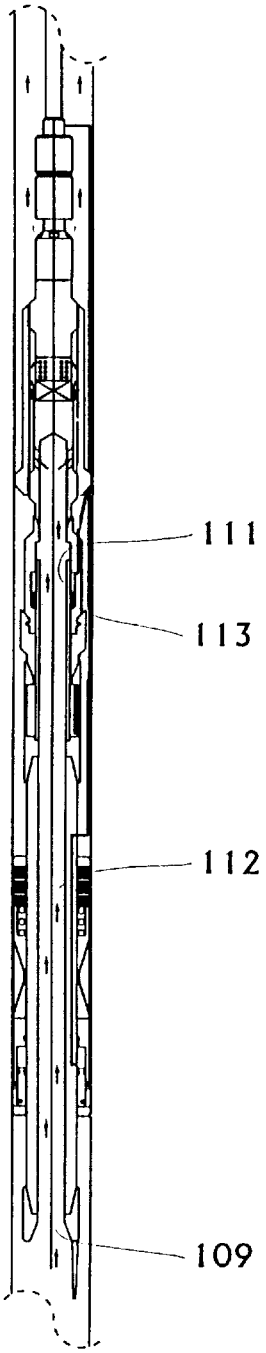
Figure 16:
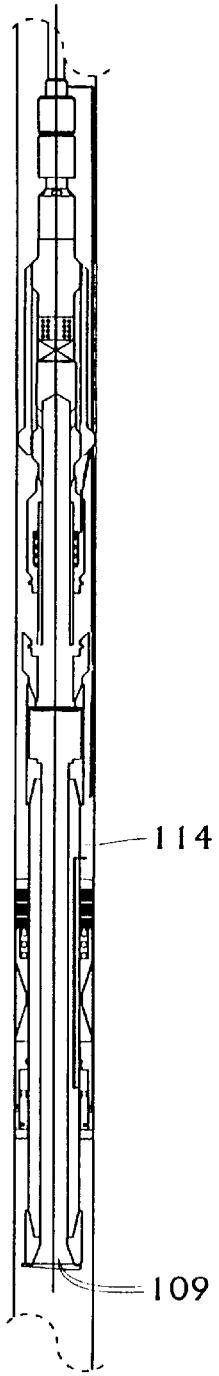

FIGS. 14 to 16 describe another possible embodiment of the bore hole safety valve system. Two control lines 100, 101 come out of the coiled tubing at the coiled tubing connector and are strapped to the outside of the pump assembly, past the pump inlet shroud 102. One control line terminates at a connection to the safety valve operating piston 104, and the other at a connection to the packer setting port 105. The assembly is conveyed into a well 106, when the CT hanger lands in the wellhead (not shown) the assembly is left hanging. Hydraulic pressure activates the grips and pressure seal 107 and 108. Flow from the well cannot now pass the eternal surface, and because of the flapper valve 109 cannot pass up the internal bore of the packer into the pump inlet 110.

Hydraulic pressure is applied to the second control line which causes the piston in the safety valve 104 to move to its lowermost position 111 shown in FIG. 15. The safety valve piston body extends to the flapper valve 109 at the bottom of the packer and in its lowermost position opens the flapper valve 109' thereby allowing fluid from the well to flow through the packer bore 112, and into the pump inlet 110.

If it is necessary to close the safety valve 109, pressure in the control line can be bled off, causing the safety valve to be returned to its upper position by the return spring 113.

In addition, when it is necessary to remove the pump for service, the safety valve operating piston is removed with the pump. However, the flapper valve 109 remains with the packer in the well and remains closed, preventing fluid from flowing from the well into the packer bore. In addition, the control line which set the packer breaks at a weak point 114 to allow the pump and valve assembly to be returned to surface.

Figure 17:
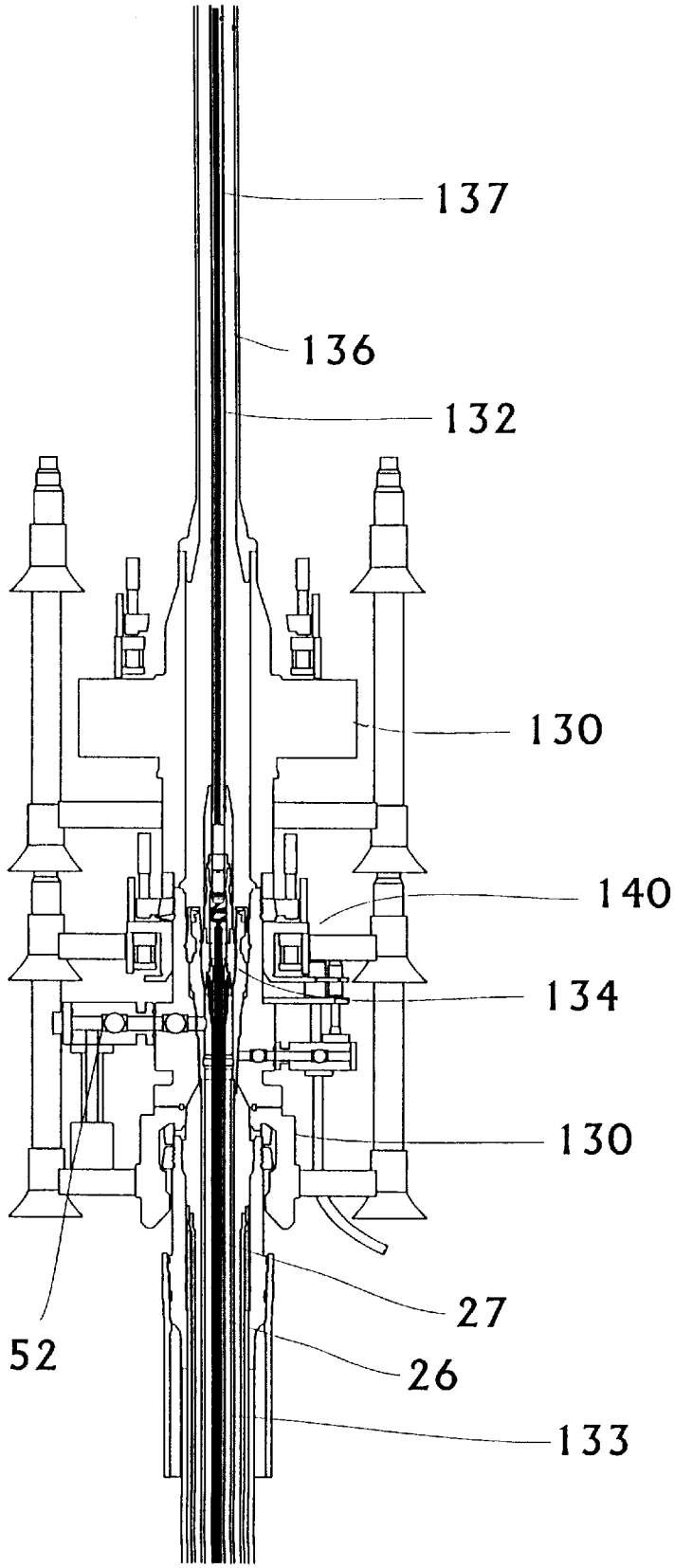
FIGS. 17 to 19 are diagrams which show an embodiment of the safety valve and pump apparatus being deployed at a seabed well head.
Figure 18:
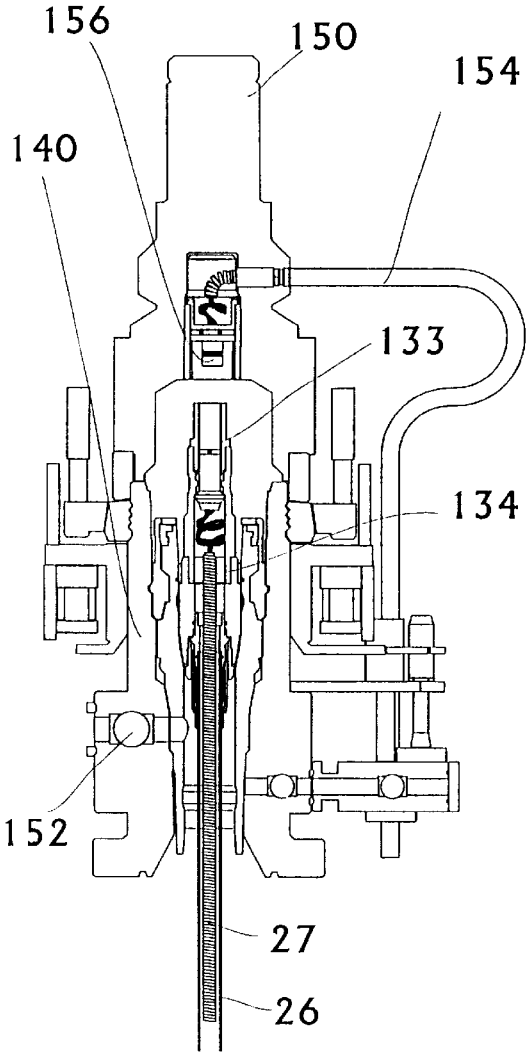
Figure 19:
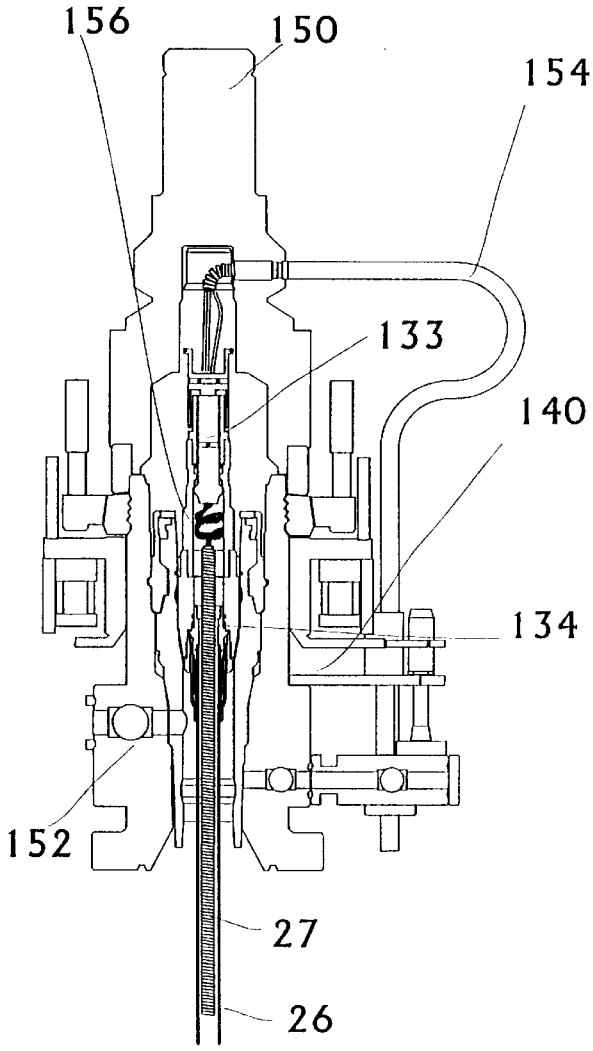

FIGS. 17 to 19 show a possible deployment of the safety valve arrangement at the seabed well head. FIG. 17 shows that a location assembly 130 can be lowered onto the tree valve block 140 from a floating vessel by large bore vessel coiled tubing 136 (this could equally be joined tubing). The pump, safety valve and packing means (not shown here) are lowered upon coiled tubing 26 through the vessel coiled tubing 136. In a preferred embodiment, the safety valve and pump would not though extend from the vessel coiled tubing until the location assembly 130 is attached to the well head. The coiled tubing 26 itself is suspended upon supplementary coiled tubing 132 meeting at a well hanger connector 134. Electric cables 137, 27 run through the supplementary coiled tubing 132, and the coiled tubing 26, respectively, also meeting at the well hanger connector 134.

The well hanger connector 134 has a larger diameter than the coiled tubing 26, pump, safety valve and packing means below it, and comes to rest at a constriction corresponding to its diameter at the well head, the coiled tubing 26, pump and safety valve now disposed in the well casing 133 and the packing means engaged with the corresponding part upon the well casing 133. The coiled tubing 26 and the pump and safety valve now hang from the well hanger connector at the well head.

The vessel coiled tubing 136 extending from the vessel to the tree valve block 140 may now be disconnected, together with the location assembly 130. The supplementary coiled tubing 132, and the electric cable 137, are automatically disconnected from the well hanger connector 134 and withdrawn at the same time as the vessel coiled tubing 136.

The tree valve block 140 includes a production flow line 152 to take oil from the well across the sea floor. Referring to FIGS. 18 and 19, a tree cap 150 may now be placed upon the tree valve block 140, either by being lowered from a vessel, or by horizontal translation from a seabed platform next to the tree valve block. The tree cap 150 includes an electricity supply line 154. The supply line ends inside the tree cap with a connector 156 which is suspended over the well hanger connector 134. The connector 154 is then automatically lowered to engage with a socket 133 upon the well head connector 134 to supply electric cable 27, and so power and operate the pump and safety valve.

By reversing the process, the tree cap 150 may be removed and the vessel coiled tubing 136, supplementary coiled tubing 132 and location assembly 130 returned, and the supplementary coiled tubing 132 reconnected to the well hanger connector 134 in order to remove the pump and safety valve apparatus. The pump and the safety valve, or safety valve alone, may be released from the rest of the apparatus to leave them in the well casing resting upon the packer as previously described.

The pump and safety valve could alternatively be lowered on tubing other than coiled tubing, such as joined tubing.

What is claimed is:

1. A safety valve and pump apparatus for a well, said apparatus comprising:

an electric pump;

a safety valve releasably connected to said pump by a releasable pump connection;

a packing connected to said safety valve for sealing against a well casing;

a continuous length of tubing extending from the surface to the safety valve and pump; and control means for operating the safety valve and the pump and including transmission means disposed along the tubing for the transmission of control signals to the safety valve and the pump, the tubing, the safety valve and the pump all being concentrically aligned.

2. The safety valve and pump apparatus according to claim 1 wherein the safety valve is releasably attached to the packing means by packer connection means.

3. The safety valve and pump apparatus according to claim 1 wherein an electrical connection means is provided, and the coiled tubing and the transmission means are remotely releasably attached to the electrical connection means.

4. The safety valve and pump apparatus according to claim 3 wherein a well head electrical supply is provided, and the electrical connection means is remotely releasably attachable to the well head electrical supply.

* * * * *